United States Patent [19]

Parazader et al.

[11] Patent Number: 5,035,093

[45] Date of Patent: Jul. 30, 1991

[54] BUILDING STRUCTURE WITH FIXED CENTER AND MOVABLE PERIMETER ROOF SECTIONS

[75] Inventors: Stephen Parazader, Dundas; Don F. Carr, St. Catherine, both of Canada

[73] Assignee: Blenkhorn and Sawle Limited, St. Catharines, Canada; a part interest

[21] Appl. No.: 488,931

[22] Filed: Mar. 5, 1990

[51] Int. Cl.[5] ..... E04B 7/16; E04H 3/10

[52] U.S. Cl. ..... 52/64; 52/6; 52/66; 98/121.1

[58] Field of Search ..... 52/6, 7, 8, 9, 80, 81; 98/38.8, 38.6, 38.7, 121.1, 121.2, 38.5

[56] References Cited

U.S. PATENT DOCUMENTS

| | | | |
|---|---|---|---|
| 3,338,000 | 8/1967 | Ostrander | 52/2 G |
| 3,766,691 | 10/1973 | Ray | 52/66 |
| 3,783,768 | 1/1974 | Caming | 98/121.2 |
| 3,999,336 | 12/1976 | Bance | 52/80 |
| 4,345,410 | 8/1982 | Geiger | 52/2 G |
| 4,727,688 | 3/1988 | Kida | 52/66 |
| 4,751,800 | 6/1988 | Kida | 52/66 |

FOREIGN PATENT DOCUMENTS

| | | | |
|---|---|---|---|
| 320475 | 11/1970 | Sweden | 52/66 |

OTHER PUBLICATIONS

Architectural Record, Oct. 1952, pp. 136–139.

*Primary Examiner*—John E. Murtagh

[57] ABSTRACT

The present invention provides a building structure with a two part roof including a first generally horizontal top fixed roof part and a second roof part extending downwardly outwardly from the first roof part and formed by sliding panels for retractability of the second roof part. The first and second roof parts are separated by a first roof support which is under compression with a second roof support which is under tension being provided below the second roof part.

10 Claims, 6 Drawing Sheets

FIG.5.
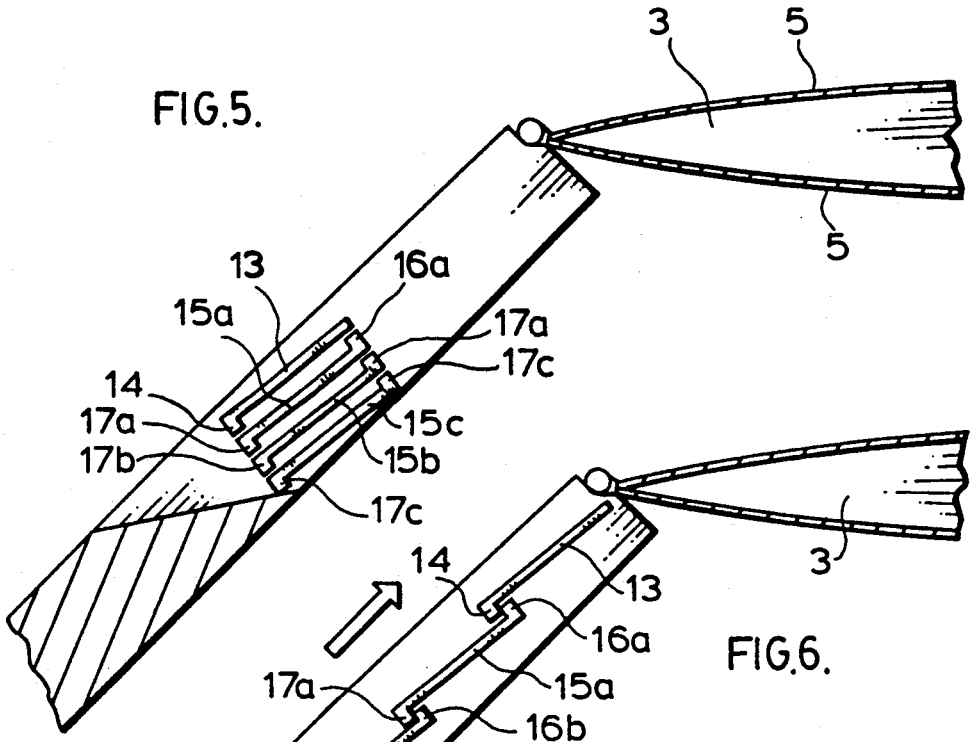
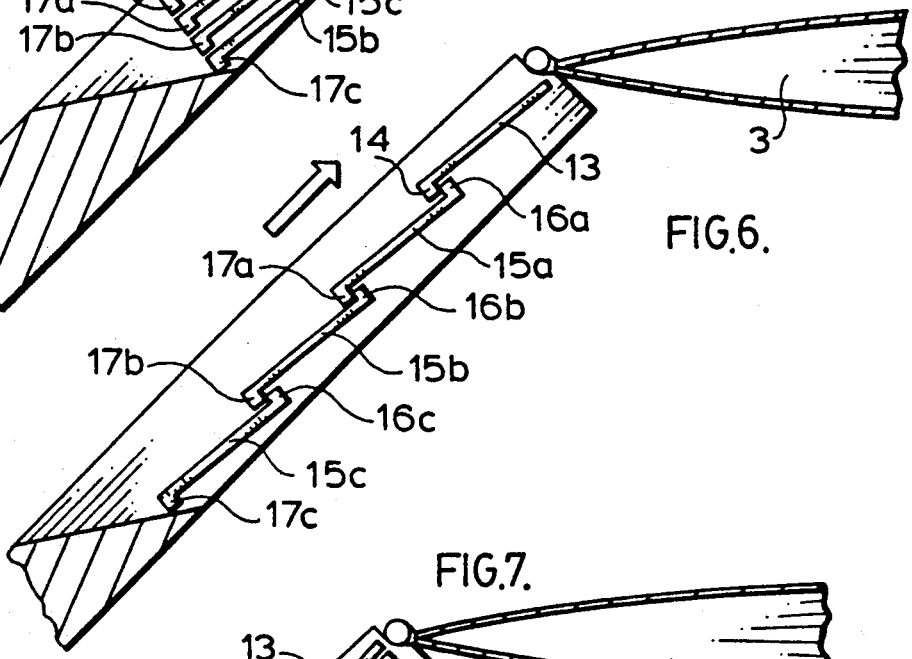
FIG.6.
FIG.7.
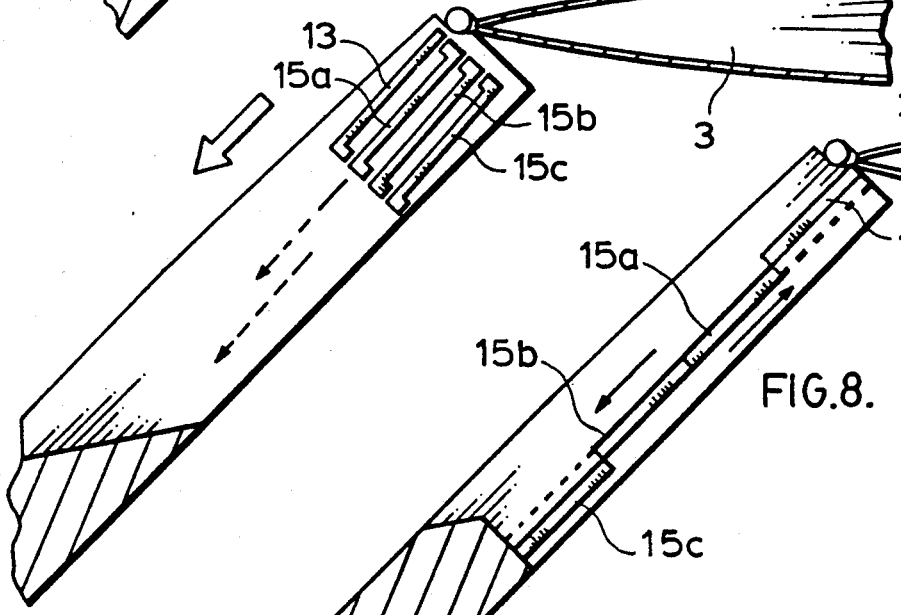
FIG.8.

BUILDING STRUCTURE WITH FIXED CENTER AND MOVABLE PERIMETER ROOF SECTIONS

This is a continuation of application Ser. No. 07/258,865, filed OCT. 17, 1988, now abanded.

FIELD OF THE INVENTION

The present invention relates to a building construction having a two part roof structure including a top horizontally extending fixed roof part and a downwardly outwardly angled roof part beneath the top roof part. The downwardly outwardly angled roof part is formed from groups of panels which slide relative to one another for retractability of the second roof part.

BACKGROUND OF THE INVENTION

In the building of sports stadiums and the like, there has been an ever increasing tendency to go to retractable roof designs allowing an outdoor feeling in good weather conditions and the closing of the roof in bad weather conditions.

The standard arrangement in a retractable roof is one which includes central roof sections which retract to provide a single central roof "overhead" opening.

Several problems result from the construction described immediately above. Firstly, during most times of the day, the sun is not in fact directly overhead and therefore the center roof opening does not maximize the effect of the sun. Furthermore in some cases, the shadows thrown by the position of the sun relative to the center opening creates severe problems for athletes playing within the building or stadium, and for T.V. monitoring.

A further problem encountered with the overhead type opening is that it is essentially stagnant and is not well exposed to air circulation. The only way for the outside air to enter the stadium is to come directly down through the opening. In fact, the opposite is more likely to be true where there tends to be a suction of air out of rather than into the stadium.

Still another problem with the overhead retractable roof is that it necessitates the handling of very large pieces of moving roof sections which are both awkward and expensive.

SUMMARY OF THE PRESENT INVENTION

The present invention provides a building construction particularly suited for the building of sports stadiums and the like having a two part roof including a first generally horizontal top or central roof part and a second perimeter roof part angled downwardly outwardly from the central roof part. Unlike conventional designs, the central roof part is fixed while the perimeter roof part is formed by a plurality of groups of multiple panels with the panels in each group being movable relative to one another for opening and closing the perimeter roof part.

The building structure further includes a first roof support under compression between the central and perimeter roof parts and a second roof support under tension below the perimeter roof part. The use of these two roof supports under compression and tension respectively provides an extremely strong stable overall support for the building roof structure.

BRIEF DESCRIPTION OF THE DRAWINGS

The above as well as other advantages and features of the present invention will be described in greater detail according to the preferred embodiments of the present invention in which:

FIG. 5 is an enlarged sectional view through the two part roof assembly of the building of FIG. 1 and showing the panels in the perimeter roof part in a downwardly retracted position.

FIG. 6 is a view similar to FIG. 5 showing the panels in the closed position.

FIG. 7 is a view similar to FIG. 5 but showing the panels in an upwardly retracted position.

FIG. 8 is a further view similar to FIG. 5 and showing a different panel arrangement where the panels bipart for retracting in both the up and the down positions.

DETAILED DESCRIPTION ACCORDING TO THE PREFERRED EMBODIMENTS OF THE PRESENT INVENTION

Figure 1:
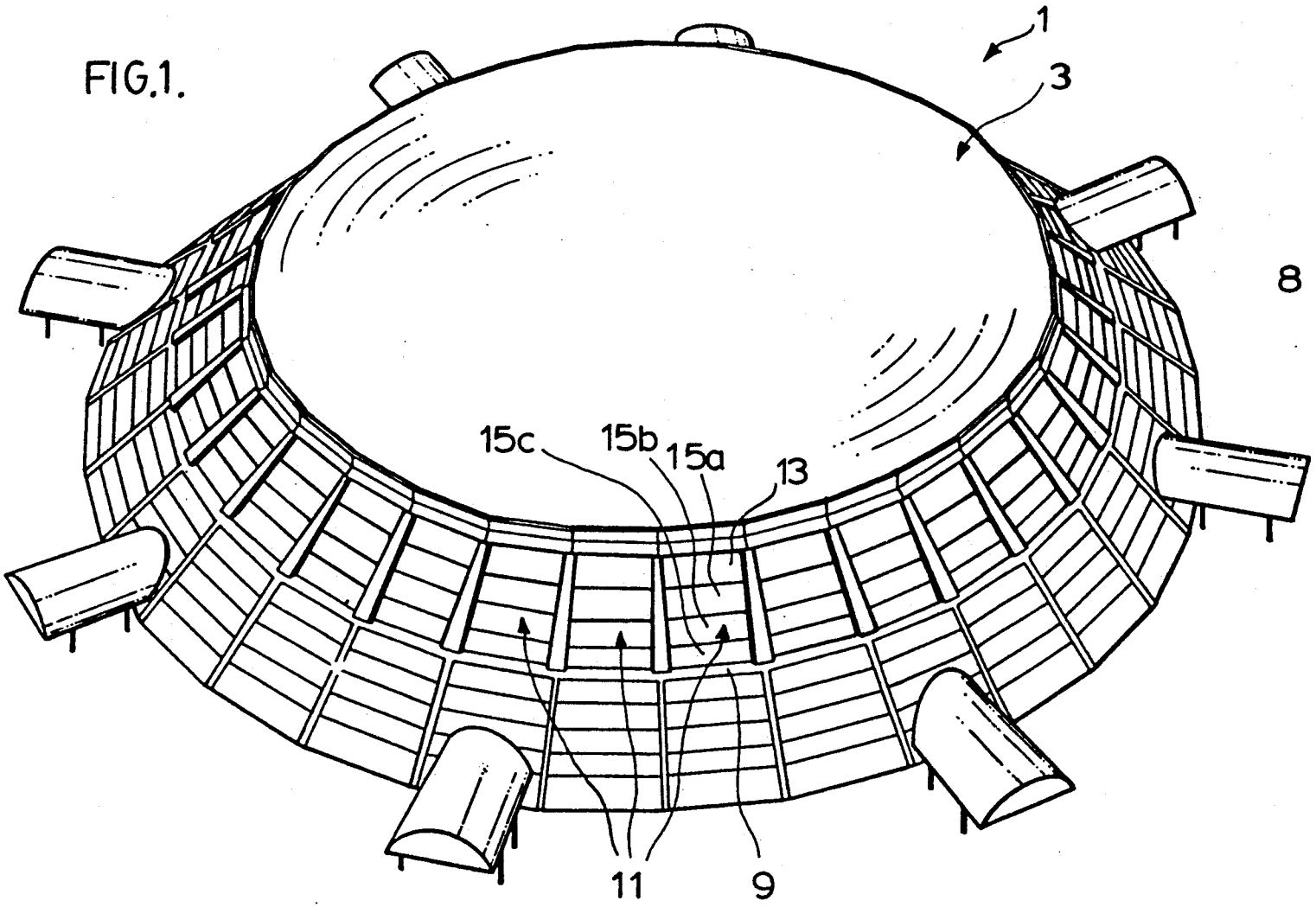
FIG. 1 is a perspective view of a building construction including a two part roof design with the second or perimeter roof part in a closed position according to a preferred embodiment of the present invention.
Figure 2:
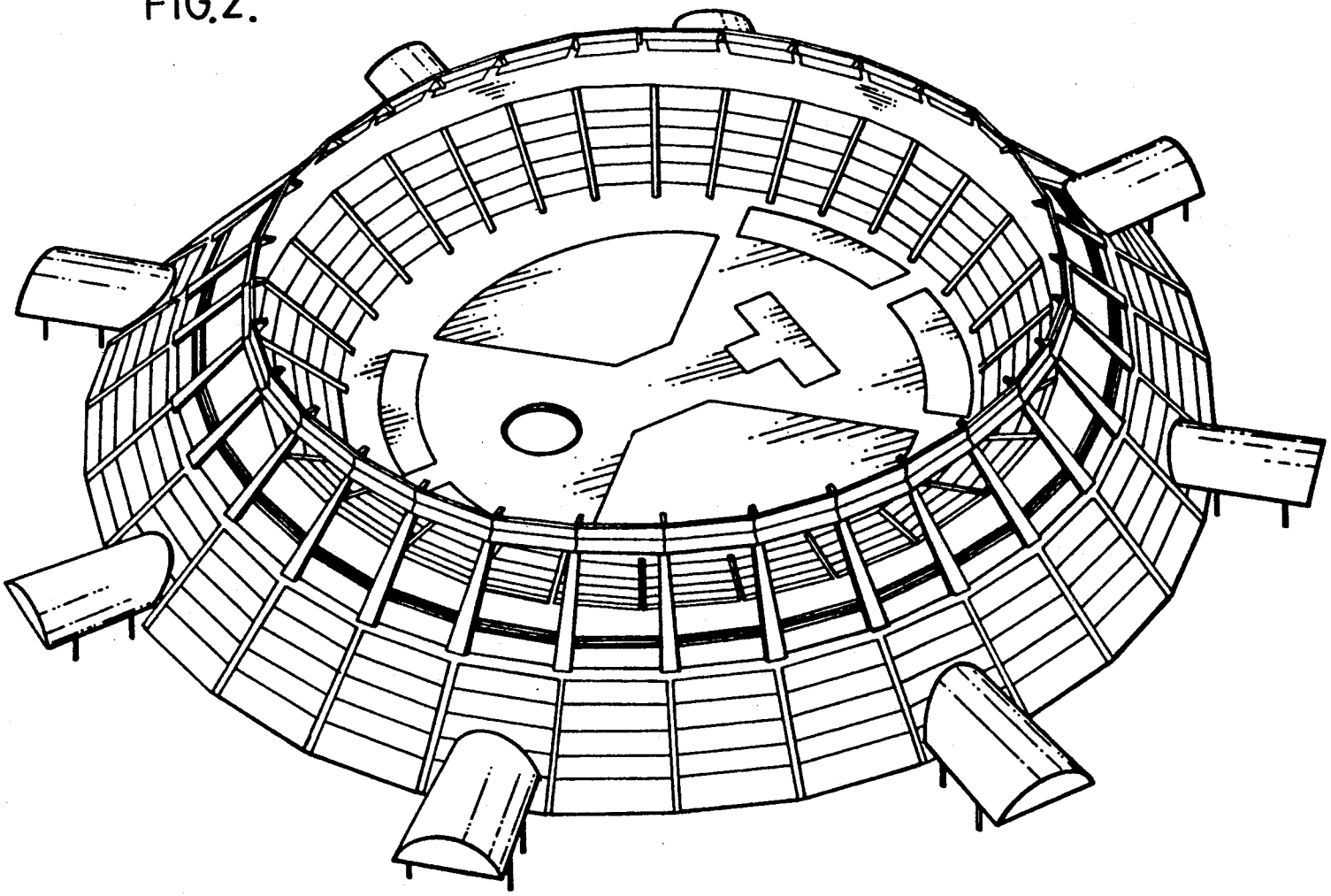
FIG. 2 is a view of the same stadium as shown in FIG. 1 prior to the fitting of the central overhead roof part and with the perimeter roof part in a partially retracted position.

FIG. 1 shows a building structure which can be any type of a building such as a hotel, a shopping complex or the like and in this case, the building is a sports stadium generally indicated at 1. This sports stadium is built with a two part roof design including a first top or central roof part generally indicated at 3 and second perimeter roof part generally indicated at 8. This second roof part is, as can be seen in FIGS. 1 and 2, downwardly outwardly angled beneath the first roof part. Here it should be noted that the second roof part is set preferably at an upward inward angle of less than 60° as opposed to, what would be classified as a wall which would be anything at 60° and over.

Figure 3:
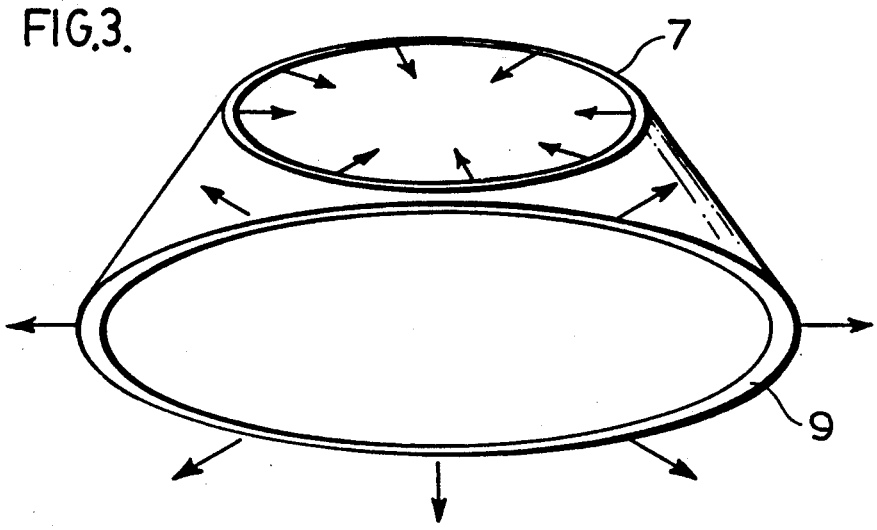
FIGS. 3 and 4 are concept views both without and with a center roof of the building design and showing loading on that design.

Because the stadium has such a large roof area formed by the two part roof design, it is important to provide proper stabilization and support for each of the roof parts. This is achieved through the use of an upper supporting member 7 and a lower supporting member 9 both of which can be seen in FIGS. 3 and 4 of the drawings. Because the building has a frusto-conical configuration, both of these supports have a ring-like shape. The upper ring-like support between the first and second roof parts is with the frusto-conical shaping of the perimeter roof part under compression as indicated by the arrows in FIG. 3, i.e. the upward inward angling of the design puts a constant inward pressure on ring support 7. The lower ring on the other hand is under constant tension, again indicated by the arrows in FIG. 3. Because the compressive and tensioning forces are in the same plane as the supports 7 and 9 respectively and because these supports have a uniform ring shape, maximum use is made of the strength of the material. Preferably steel is used to form the tension ring while either steel or concrete is preferably used for the compression ring.

Figure 4:
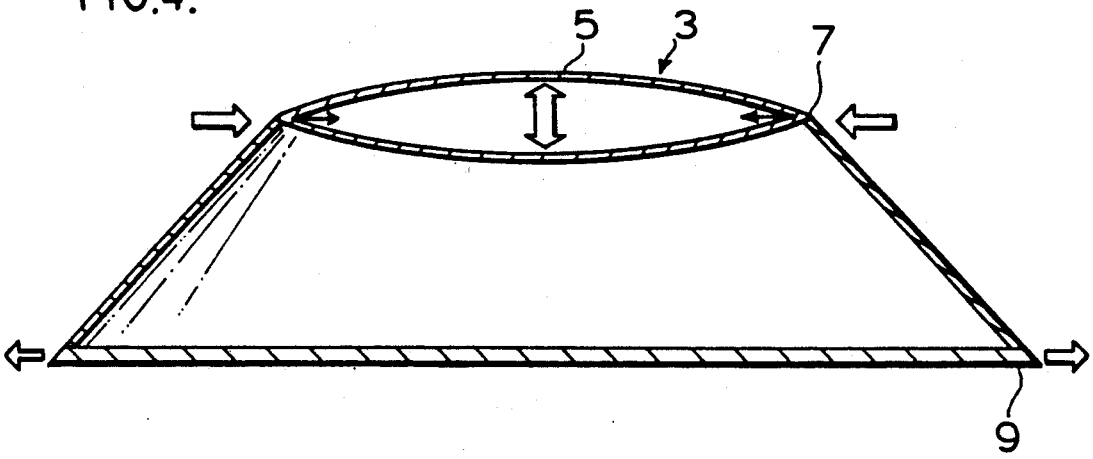

The first or center roof part can be made from many different types of constructions presently available ranging from the standard radial truss type roof design to much newer roof designs such as the inflated steel membrane roof as shown in FIG. 4 of the drawings. The inflated roof structure which, because of internal pressurization wants to assume a spherical shape, is prevented from doing so due to its connection to the upper supporting ring further adding to the compressive forces on the supporting ring. However, it is to be understood that regardless of what type of roof design is used, the upper ring is under constant compression and the lower ring is under constant tension as a direct result of the sloping of the perimeter roof part.

Again, regardless of what type of central roof part is used, it always remains in a fixed position unlike conventional retractable roofs.

In accordance with the present invention it is the second perimeter roof part 8 which is retractable. This second roof part consists of a plurality of groups of panels generally indicated at 11 with the groups of panels being extended all the way around the building or stadium. Each one of these groups of panels is formed by individual panels slideable relative to one another. FIGS. 5 through 7 show the slideable panels as consisting of a top panel 13 and a plurality of lower panels 15*a*, b and c.

Each of the panels 13 has a downwardly turned lower end 14 while each of the panels 15*a, b* and *c* has an upwardly turned end 16*a, b* and *c* and a downwardly turned lower end 17*a, b* and *c* respectively. When the panels are in the non-retracted position as shown in FIG. 6 of the drawings, the downwardly turned end 14 of panel 13 engages with the upwardly turned end 16*a* of panel 15*a*. The downwardly turned end 17*a* of panel 15*a* then engages with the upwardly turned end 16*b* of panel 15*b*. The downwardly turned end 17*b* of panel 15*b* engages with the upwardly turned end 16*c* of panel 15*c*.

The panels are quickly and easily moved to a retracted position as shown in either FIGS. 5 and 7 of the drawings. In the FIG. 5 retracted position the upper panel 13 and the panels 15*a* and *b* are moved down immediately above the lower panel 15*c* for a downwardly stored position of the panels. FIG. 7 on the other hand shows the panels being stored in an up position for retracting the second roof part.

FIG. 1 of the drawings shows the stadium with all of the sliding roof panels in the closed position. In FIG. 2 with the top roof part removed for demonstration purposes only, the panels have been retracted and stored in the down position of FIG. 5 of the drawings. Here it should be noted that panel movement at each of the groups of panels is controlled individually from group to group for a selective lowering and raising of any of the panels. In other words, the panels on one side of the stadium can be retracted while the panels on the opposite side of the stadium remain in the up or closed position. This allows for maximum control of the retractable roof for positioning relative to the sun, wind or opening and closing relative to inclement weather such as rain or the like.

The movement of the panels are preferably controlled by a computerized operation not shown in the drawings. The computerized operation can operate on an automatic mode where the panels open and close according to the time of the day for appropriate following of the sun. The control would also include an override for quickly and easily closing the panels on an urgent basis.

As will be clearly appreciated from the above, because of the downward outward angling of the second roof part, the retractability of the roof panels maximizes the effect of the sun which, as earlier noted, is not generally in a directly overhead position. Further, the angling of the retractable roof part allows ventilation or wind travel in and out of the building or stadium. As a further important benefit the retracting of the perimeter rather than the overhead roof part provides a panoramic view for the audience who can look out to the surrounding scenery rather than having to look straight up into the sky.

Figure 9:
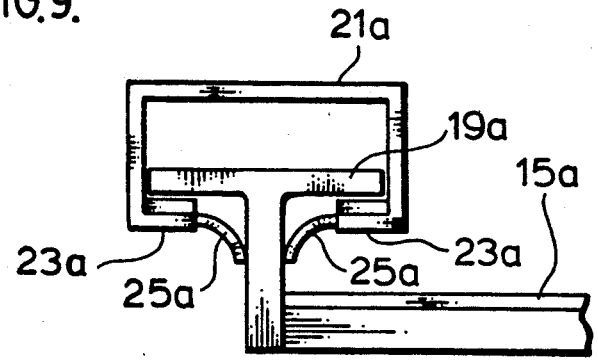
FIG. 9 is an enlarged sectional view through the track system used for movement of the panels according to a preferred embodiment of the present invention.
Figure 10:
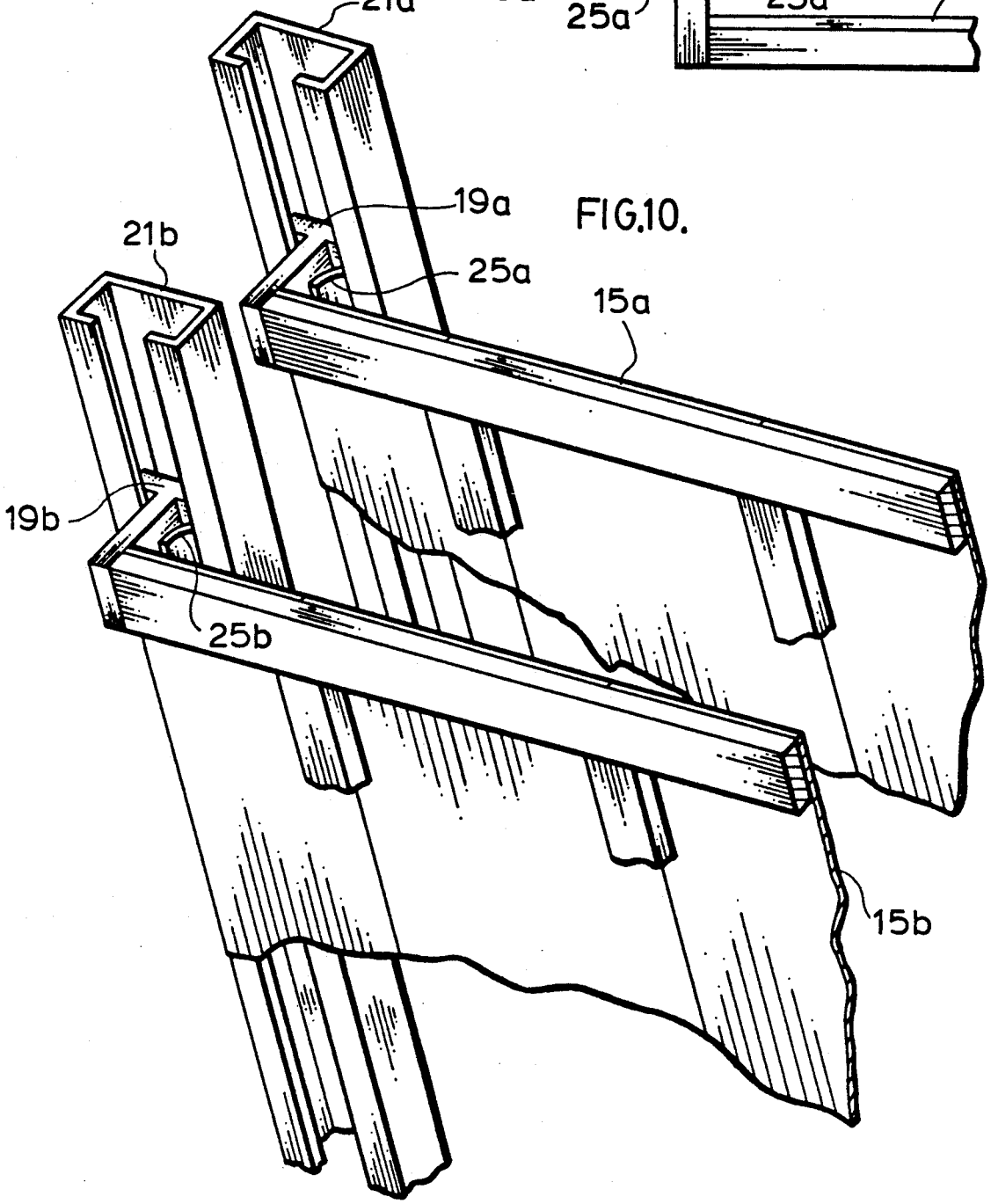
FIG. 10 is a bottom perspective view of two of the panels and their track systems, again according to a preferred embodiment of the present invention.

Each of the roof panels, whether they be roof panels 13 or 15*a, b* or *c*, are preferably operated using a track system as shown in FIGS. 9 and 10 of the drawings. For illustration purposes only, reference is had to the panels 15*a* and 15*b*. Each of these panels is other than the end to end engagement when in the fully closed position, independent of each of the other panels. The tracks for the panels are positioned overlaying one another with the panels themselves being separated from one another by a distance to avoid interference between the panels during retracting and closing of the roof.

More particularly, each of the panels 15*a* and 15*b* include a T-like runner arm 19*a* and 19*b* at opposing sides of the panels. The runner arms 19*a* and 19*b* are located in downwardly opening channel guide 21*a* and 21*b*. The lower surface of the guides are provided with low friction surfacing material as indicated at 23*a* in FIG. 9 for ease in moving the panel. A particularly preferred material is TEFLON TM which has both low friction and high durability characteristics for a long smooth flowing interfitting between the panel arm and the guide.

The downwardly opening channel design of guides 21*a* and 21*b* have been designed for minimizing the likelihood of foul up or dirt accumulating within the guides. In particular, because the guides open downwardly, they are not generally exposed to the outside elements including rain water, which if the guides were reversed would otherwise seep down into the track system. To further enhance the isolation of the interior of the guides from any dirt buildup flexible guide covers 25*a* and 25*b* are provided which engage the side edge of the panels but which do not interfere with the movement of the panel arms within the guides. These flexible guide covers further prevent animals and particularly bird nesting within the panel guides which has become a problem with current retractable roof designs using open channels.

Figure 11:
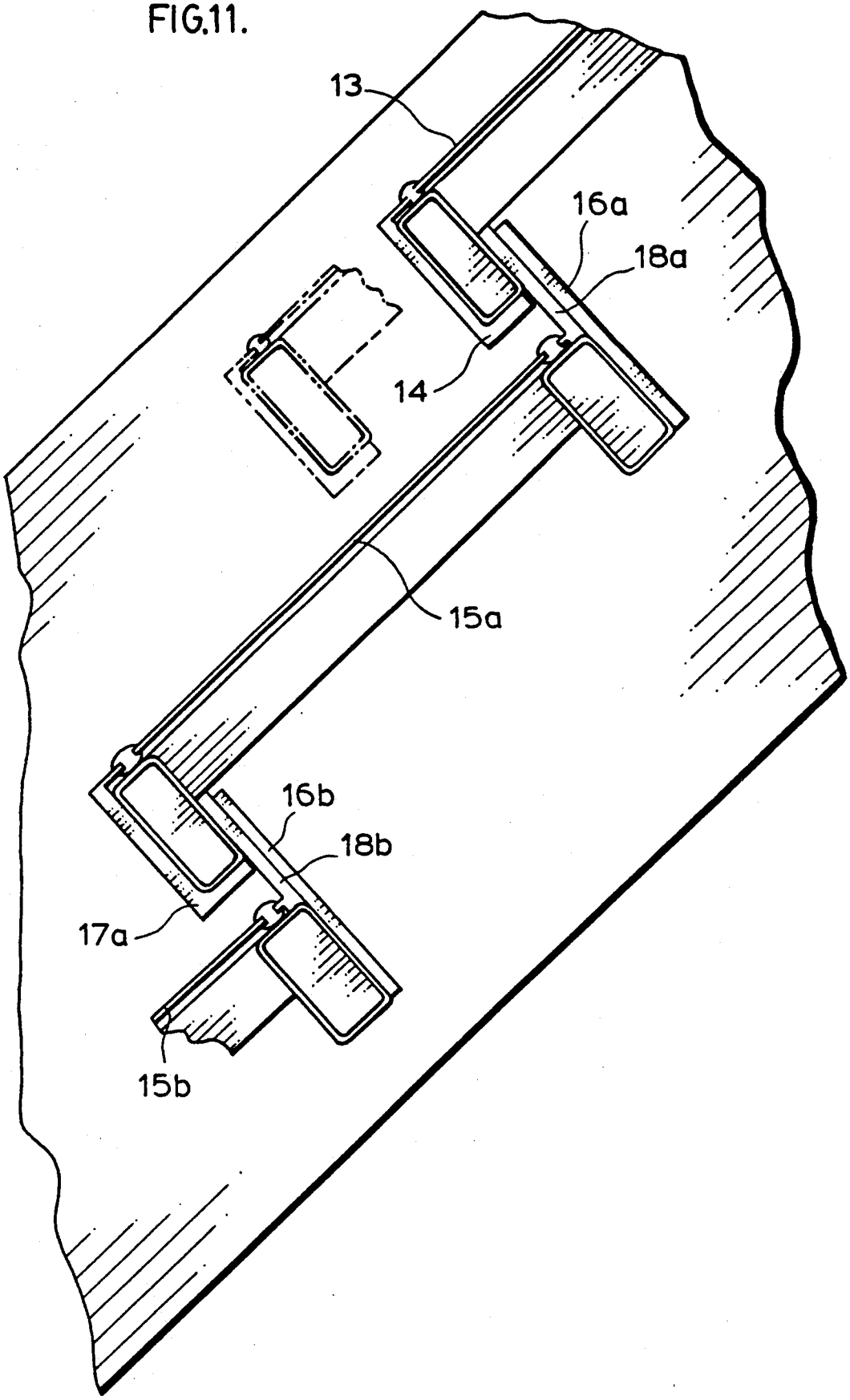
FIG. 11 is an enlarged sectional view showing the panel operation and interfitting with one another again according to a preferred embodiment of the present invention.

FIG. 11 of the drawings shows the interaction particularly in the closed position of the upper panel 13 with panel 15*a* and then panel 15*a* with the panel 15*b*. What is to be particularly noted here is that the upwardly turned ends 16*a* and 16*b* of each of the panels 15*a* and 15*b* are provided with an interior shock absorbing material 18*a* and 18*b* which helps to absorb impacts as the panels come to a fully closed position as shown in FIG. 11 of the drawings.

The description with respect to FIGS. 5 through 7 of the drawings relates to the panels being retracted and stored in either an up or down position. FIG. 8 shows a biparting panel arrangement where the roof panels are retracted by moving some of them downwardly and others upwardly. The panels moving in opposite directions are interconnecting with one another so that this particular arrangement has the benefit that the weight of the panels in the downwardly moving group can be used to offset the weight required to move the panels which move upwardly. Accordingly, only a very small counterbalancing weight or a small external driving force is required to either open or close the panels moving in the opposite directions.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A building structure having a two part multiple angle roof including a first generally horizontal top roof part and a second roof part angled downwardly outwardly from said first roof part, a first roof support under compression between said first and second roof parts and a second roof support under tension below said second roof part, said first roof part spanning said first roof support atop said structure, said second roof part being formed by a pluraltiy of side by side rows of multiple panels with the panels in each row being slideable upwardly and downwardly over one another for opening and closing of said second roof part, the panels in said second roof part, when closed, meeting generally peripherally with said first roof part.

2. A building structure as claimed in claim 1 having a generally frusto-conical configuration with said top roof part being flat and said second roof part being set at a downward outward angle to ground level below said first roof part.

3. A building structure as claimed in claim 1, wherein each of said panels has upper and lower turned ends, the upper and lower ends on each panel being turned in opposite directions.

4. A building structure as claimed in claim 1 wherein each panel has a turned end trapped and moveable between opposing ends of an adjacent panel in each row.

5. A building structure as claimed in claim 1, wherein the panels in each row are moveable along guide tracks having guide slots opening downwardly into said structure.

6. A building structure as claimed in claim 5, wherein each panel includes a panel portion fitted into said guide slot, said guide track including flexible guide covers against said panel portion.

7. A building structure as claimed in claim 1, wherein said panels are tiered relative to and slide along a linear path over one another to a stacked storage position when said second roof part is opened.

8. A building structure as claimed in claim 7, including a plurality of panel guide tracks in each of said rows, said guide tracks overlaying and being separated from one another to provide sliding clearance between said panels.

9. A building structure as claimed in claim 4, including shock absorbing material between said turned end of said panel and said opposing ends of the adjacent panels.

10. A building structure as claimed in claim 1, wherein said second roof part is at at constant downward, outward slope relative to said first roof part, said panels sliding path along a straight path for opening and closing said second roof part.

* * * * *